United States Patent [19]

Lincke

[11] Patent Number: 4,532,965

[45] Date of Patent: Aug. 6, 1985

[54] WEFT YARN PICKING CHANNEL

[75] Inventor: Paul Lincke, Zell, Switzerland

[73] Assignee: Sulzer Brothers Limited, Winterthur, Switzerland

[21] Appl. No.: 528,119

[22] Filed: Aug. 31, 1983

[30] Foreign Application Priority Data

Sep. 14, 1982 [CH] Switzerland ..... 5437/82

[51] Int. Cl.[3] ..... D03D 47/30

[52] U.S. Cl. ..... 139/435; 139/192; 139/47; 139/30

[58] Field of Search ..... 139/435, 188, 192; 226/97

[56] References Cited

U.S. PATENT DOCUMENTS

| | | | |
|---|---|---|---|
| 1,070,206 | 8/1913 | Terryberry | 139/192 |
| 1,294,671 | 2/1919 | Kaufmann | 139/192 |
| 1,721,940 | 7/1929 | Ballou | 139/435 |
| 3,139,118 | 6/1964 | Svaty et al. | 139/435 |
| 3,958,609 | 5/1976 | Zollinger | 139/435 |
| 4,354,534 | 10/1982 | Sulser et al. | 139/435 |
| 4,380,254 | 4/1983 | Bonasch et al. | 139/435 |

FOREIGN PATENT DOCUMENTS

| | | | |
|---|---|---|---|
| 472458 | 2/1929 | Fed. Rep. of Germany | 139/192 |
| 13185 | of 1896 | United Kingdom | 139/192 |

*Primary Examiner*—Henry S. Jaudon

*Attorney, Agent, or Firm*—Kenyon & Kenyon

[57] ABSTRACT

The weft yarn picking channel is constructed for use in pneumatic weaving machines. In one embodiment, the picking channel is formed of discrete guide elements of wire construction which are secured on a sley. In another embodiment, the guide elements can be incorporated in a reed via bends in the reed wires.

19 Claims, 11 Drawing Figures

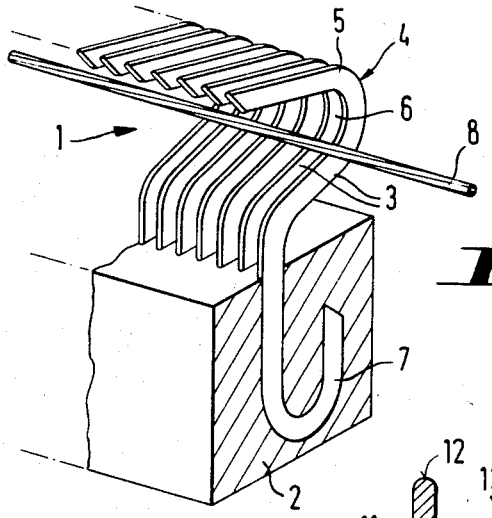
Fig. 1
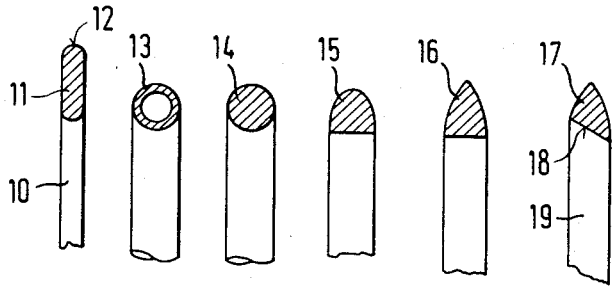
Fig. 2 a b c d e f
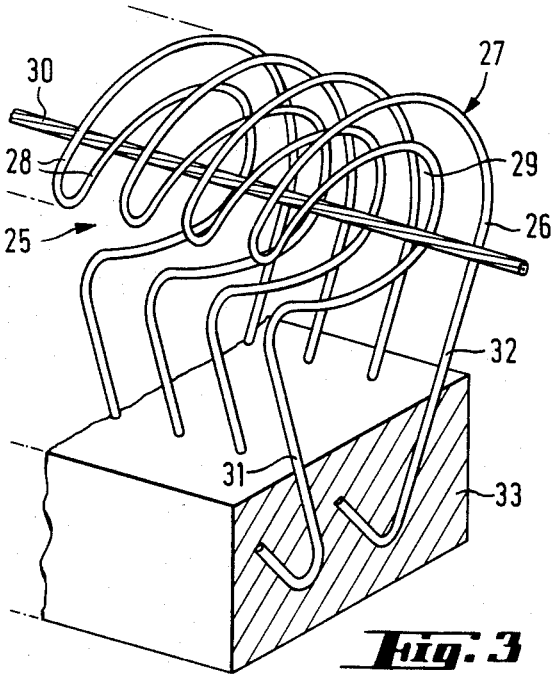
Fig. 3
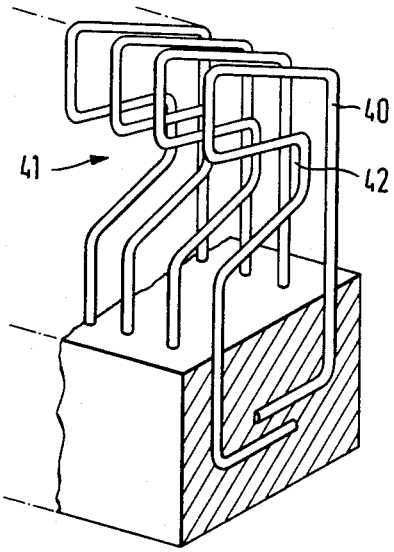
Fig. 4

WEFT YARN PICKING CHANNEL

This invention relates to a weft yarn picking channel and particularly to a weft yarn picking channel for a pneumatic weaving machine.

Heretofore, two kinds of weft yarn picking channels have been known for use in pneumatic weaving machines. In one case, the picking channel has been formed by discrete solid guide elements which are disposed side-by-side on a sley. However, this construction has a disadvantage in that the guide elements are expensive to manufacture. Another disadvantage is that the guide elements require a relatively elongated shed apex in order to enable the guide elements to emerge from the shed. This translates into a loss of output and space in the weaving machine.

The other known picking channel is formed by providing recesses in the blades of a reed, for example as described in Swiss Pat. No. 613,137. However, such a channel is expensive to manufacture since the blades have been stamped out and the formation of the recesses necessitates a subsequent edge rounding operation. Another disadvantage is that when there is a change over in the weaving machine to different fabrics, widths or the like, it may be necessary to replace the reed by a reed having a different set, i.e. blade pitch.

Accordingly, it is an object of the invention to provide a weft yarn picking channel which can be made in a relatively inexpensive manner.

It is another object of the invention to provide an inexpensive weft yarn picking channel which can be mounted on a sley.

It is another object of the invention to provide a weft yarn picking channel which can be readily incorporated in a reed in an inexpensive manner.

Briefly, the invention provides a weft yarn picking channel for a pneumatic weaving machine which is formed of a plurality of discrete guide elements which are disposed in longitudinally disposed parallel relation and formed of a wire structure.

In one embodiment, the guide elements are mounted in a sley. In this case, the individual elements may be formed with various cross-sectional shapes while also being contoured in various manners to define differently shaped guide channels for a weft yarn.

In another embodiment, the guide elements are incorporated in a reed frame. In this embodiment, the guide elements may be formed with ends of circular cross-section which are secured in the frame in an abutting manner while having flattened portions extending between the ends to define the guide channel.

These and other objects and advantages of the invention will become more apparent from the following detailed description taken in conjunction with the accompanying drawings wherein:

FIG. 1 illustrates a perspective view of a part of a picking channel constructed in accordance with the invention;

FIGS. 2*a*–2*f* illustrate various cross-sections of a wire used to form a guide element in accordance with the invention;

FIG. 3 illustrates a modified picking channel in accordance with the invention;

FIG. 4 illustrates a further modified picking channel in accordance with the invention;

Figures 5, 6, 7:
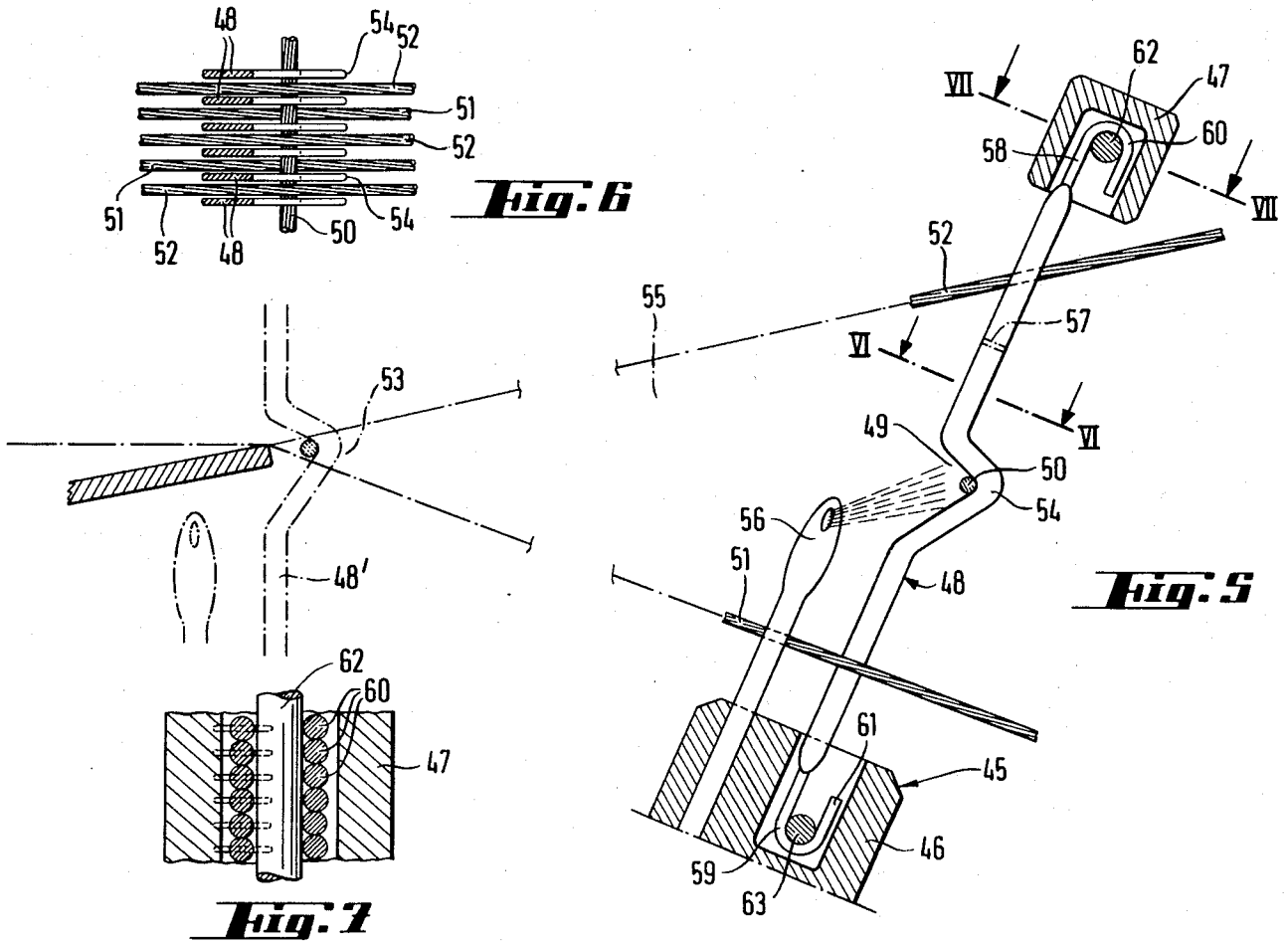
FIG. 5 illustrates a modified picking channel incorporated in a reed in accordance with the invention.
FIG. 6 illustrates a view taken on line VI—VI of FIG. 5.
FIG. 7 illustrates a view taken on line VII—VII of FIG. 5.

Referring to FIG. 1, the weft yarn picking channel 1 is constructed, for example for use in a pneumatic weaving machine, and includes a plurality of discrete guide elements 3 which are disposed in longitudinally disposed parallel side-by-side relation on a sley 2. Each guide element 3 consists of a one piece wire structure 4 which is bent from a straight piece of wire. As shown, each guide element 3 comprises a bent part 5 forming a trapezoidal guide 6 for a weft yarn 8. In addition, each guide element 3 has a hook-shaped part 7 which is used to fix the guide element 3 in the sley 2. The guide elements 3 together form a picking channel for the weft yarn 8 and a flow channel for picking air for conveying the weft yarn through the channel 1.

Referring to FIG. 2, each guide element may be formed of a wire having a cross-section of different shape. For example, as indicated in FIG. 2*a*, the wire 10 may have a substantially rectangular cross-section 11. Such a wire 10 may be formed by rolling from a circular wire so as to impart a semi-circular front edge 12 which is of advantage for penetration between warp yarns (not shown) of a shed formed in the weaving machine. The guide elements 3 of FIG. 1 have a cross-section of this type.

Referring to FIG. 2*b*, each guide element may be formed of a wire which is formed from a tube 13. Alternatively, as shown in FIG. 2*c*, the wire may have a solid circular cross-section 14. Further, the wire may have a semi-circular cross-section 15 as shown in FIG. 2*d*; a semi-oval cross-section 16 as shown in FIG. 2*e* or a semi-oval cross-section 17 with a flat base 18 disposed at an angle such that the diameter of the resultant guide channel 19 increases in the picking direction as shown in FIG. 2*f*. The formation of the wire as illustrated in FIG. 2*f* promotes the flow of picking air through the guide channel 19.

Referring to FIG. 3, a picking channel 25 may be made from guide elements 26 consisting of a wire structure 27 in the form of a loop. As indicated, the wire structure 27 comprises a double turn 28 to form an oval passage 29 for a weft yarn 30. The wire structure also has a pair of free ends 31, 32 which are secured adjacent to each other in a sley 33.

Referring to FIG. 4, the picking channel may also be formed of guide elements 40 which are shaped to form a picking channel 41 in the form of a frame. As indicated, the guide elements 40 form a trapezoidal passage 42 for the weft yarn while the free ends are secured in a sley.

Of note, the guide elements may have different configurations. Generally, the guide elements are made as copies of the known solid guide elements.

Referring to FIG. 5, the picking channel may be incorporated into a reed. To this end, the reed 45 is formed with a frame having top and bottom members 46, 47. In addition, a large number of reed wires are disposed between the frame members 46, 47 in order to form a plurality of discrete guide elements 48 for a picking channel 49 for a weft yarn 50 while also serving to beat-up the weft yarn 50. As indicated, the reed is disposed transversely of a shed 55 which is formed by warp yarns 51, 52 which extend to a shed apex 53. These warp yarns 51, 52 extend between each two reed wires i.e. guide elements 48. In addition the picking channel 49 is open towards the shed apex 53.

As indicated in FIGS. 5 and 6, each guide element 48 is provided with an intermediately disposed bend 54 in order to define the picking channel 49. To this end, each guide element 48 is rolled from a round wire so as to have a flat cross-section 57 (see FIG. 5) between the frame members 46, 47. The wire is shaped before being rolled flat so that there is no need for finishing at the edges. The two ends 58, 59 of the wire, however, are not rolled so as to maintain a circular cross-section. These circular ends 58, 59 are bent over to form hooks 60, 61 and each is engaged around a rod 62, 63 secured in their respective frame members 46, 47. As indicated in FIG. 7, the guide elements 48 are abutted against each other within the frame members 46, 47. Thus, the diameter of each hook 60, 61 is exactly the same as the reed set, i.e. pitch of the guide elements. Thus, the guide elements 48 can be readily combined to form a reed with each pair of guide elements forming a passage for a respective warp yarn.

Referring to FIG. 5, when the shed 55 is opened, a weft yarn 50 can be conveyed through the picking channel 49 and picked by blower nozzles 56, for example mounted on the lower reed member 46 in suitable manner. After the weft yarn 50 has been picked, the reed 45 is swung to the left, as viewed, so that the weft yarn 50 lying in the picking channel 49 is beaten up by the guide elements 48 upon reaching the indicated position 48'.

Figure 8:
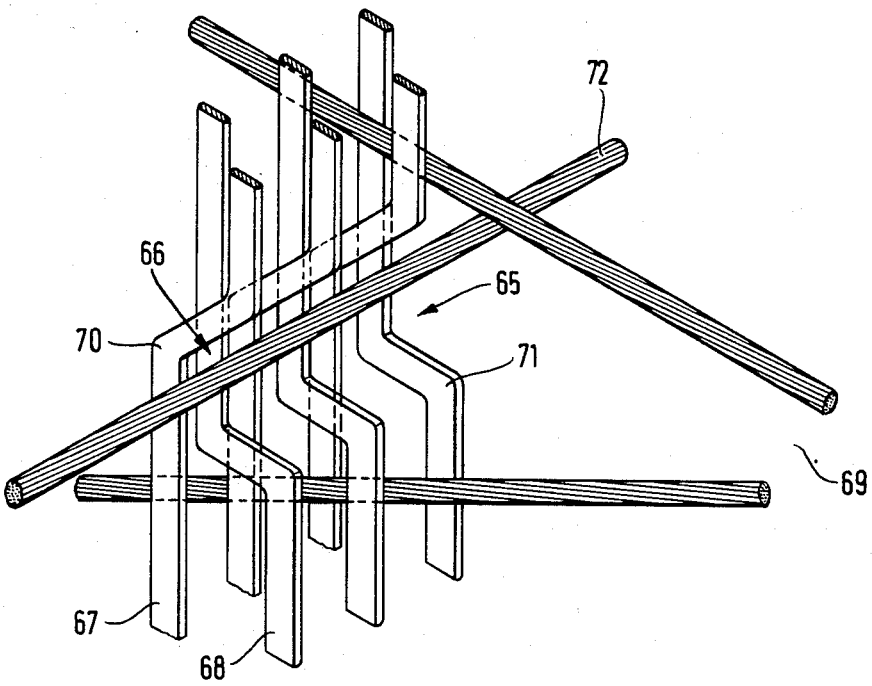
FIG. 8 illustrates a modified arrangement of guide elements for a reed in accordance with the invention.

Referring to FIG. 8, a picking channel 65 may be formed of pairs of guide elements. For example, each guide element 66 which defines a channel element may be formed by two adjacent flat reed wires 67, 68. One reed wire 67 has a rearward bend 70 as considered from the direction of the shed apex 69 while the other reed wire 68 has a forward bend 71. The two wires 67, 68 are disposed in the reed (not otherwise shown) in such a manner that the longitudinal axes of the wires are offset. Thus, the bends in the wires 67, 68 produce the guide elements 66 and all of the guide elements together form the picking channel for a weft yarn 72.

Figure 9:
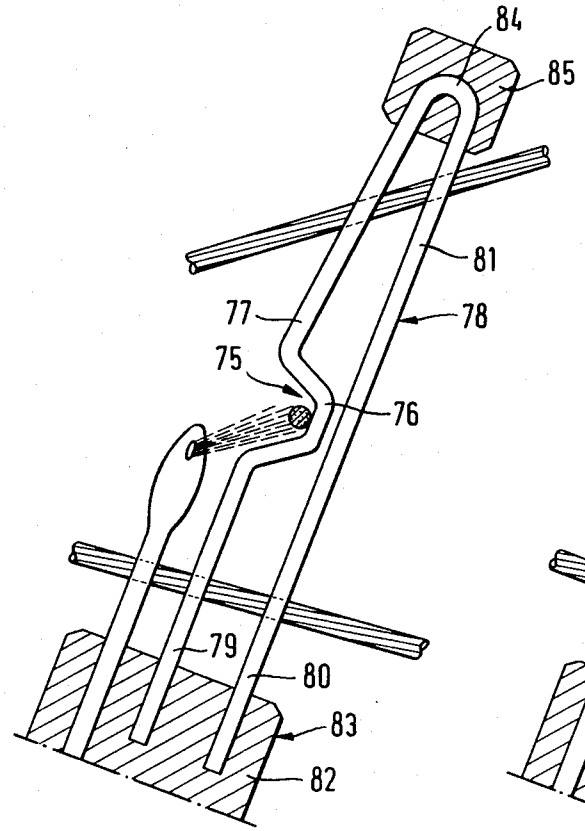
FIG. 9 illustrates a hair-pin like guide element constructed in accordance with the invention.

Referring to FIG. 9, a picking channel 75 may be formed by a plurality of hairpin-shaped guide elements 78 which has a bend 76 in a front limb 77. In this case, each guide element 78 has two free ends 79, 80 of the limbs 77, 81 secured in a bottom member 82 of a reed 83 while a curved portion 84 is secured in a top member 85 of the reed 83.

Figure 10:
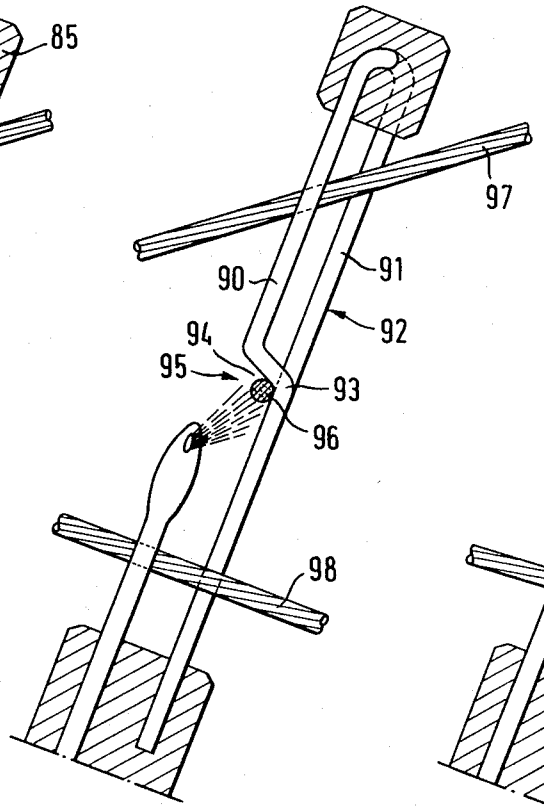
FIG. 10 illustrates a modified guide element constructed in accordance with the invention.

Referring to FIG. 10, a reed may also be constructed with a plurality of hairpin shaped guide elements 92 each of which has two limbs 90, 91 situated in different planes. As illustrated, the front limb 90 has a bend 93 to form a niche 94 which is aligned with the niches of the remaining guide elements to form a picking channel 95 for a weft yarn 96. As illustrated, the top warp yarn 97 of a shed can be situated between the parts of the limbs 90, 91 which are situated above the bend 93. The lower warp yarn 98 of the shed then extends between the front limb 90 and the nearest guide element. This construction of the guide element permits a shortening of the shed apex since the blower nozzles can be disposed closer to the picking channel. This also provides a better blowing angle for weft yarn transport.

Figure 11:
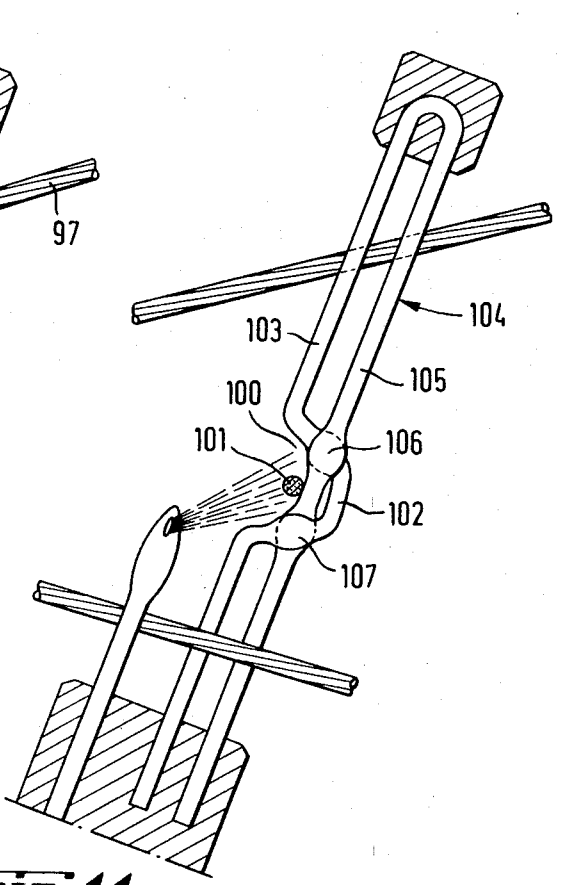
FIG. 11 illustrates a further modified guide element similar to the guide element of FIG. 9.

Referring to FIG. 11, a reed may also be provided with a plurality of hairpin-shaped guide elements 104 wherein the front limb 103 of each element is provided with a bend 102 in order to define a picking channel 100 for a weft yarn 101. As indicated, the bend 102 extends around the rear limb 105 of the guide element 104 and may be interconnected at the points of intersection 106, 107 by compression, spot-welding or gluing for reinforcement purposes.

The invention thus provides guide elements of relatively inexpensive construction which can be made to form picking channels composed of a plurality of discrete guide elements mounted, for example on a sley, or which can be incorporated in the wires of a reed.

Further, the invention provides a picking channel which can be constructed in a manner to permit use in a relatively small shed of warp yarns.

In this regard, the space required for the picking channel is at a minimum and the overall speed of a weaving machine can be increased.

What is claimed is:

1. A weft yarn picking channel for a pneumatic weaving machine, said channel including a sley and a plurality of discrete guide elements disposed on said sley in longitudinally disposed parallel relation, each said guide element being a one-piece wire structure of uniform cross-section having a hook-shaped part mounted in and extending from said sley to form a guide for a weft yarn whereby said guide elements define a picking path for picking of a weft yarn independently of a reed.

2. A weft yarn picking channel as set forth in claim 1 wherein said one piece wire forms a trapezoidal guide for a weft yarn.

3. A picking element as set forth in claim 1 wherein said wire structure has a rectangular cross-section with a long side disposed transversely of a picking direction and a short side defining a semi-circular entry side.

4. A picking element as set forth in claim 1 wherein said wire structure has a circular cross-section.

5. A picking element as set forth in claim 1 wherein said wire structure has a semi-circular cross-section.

6. A picking element as set forth in claim 1 wherein said wire structure has a semi-oval cross-section.

7. A picking element as set forth in claim 6 wherein said wire cross-section defines a base side extending obliquely outwards relative to a picking direction.

8. A picking element as set forth in claim 1 wherein said wire structure is made from a tube.

9. A weft yarn picking channel for a pneumatic weaving machine, said channel including a sley and a plurality of discrete guide elements disposed on said sley in longitudinally disposed parallel relation, each said guide element being a one-piece wire structure shaped to form a passage for a weft yarn and having a pair of free ends secured adjacent to each other in said sley whereby said guide elements define a picking path for picking of a weft yarn.

10. A picking channel as set forth in claim 9 wherein each guide element is in the form of a loop forming an oval guide for a weft yarn.

11. A picking element as set forth in claim 9 wherein each guide element forms a trapezoidal guide for a weft yarn.

12. A reed for a weaving machine comprising
a frame, and a plurality of discrete guide elements disposed in said frame in longitudinally disposed parallel relation, each pair of adjacent guide elements defining a weft guide channel element, one of each said pair of guide elements having a rearward bend and the other of said pair of guide elements having a forward bend together defining said weft guide channel element, said guide elements of each said pair of guide elements being longitudinally offset.

13. A reed as set forth in claim 12 wherein said guide elements are hair-pin shaped with a front limb thereof having a bend to define a weft guide.

14. A reed as set forth in claim 12 wherein each pair of adjacent guide elements define a weft guide channel element, one of each said pair of guide elements having a rearward bend and the other of said pair of guide elements having a forward bend together defining said weft guide channel element, said guide elements of each said pair of guide elements being longitudinally offset.

15. A reed for a weaving machine comprising a frame having a top member and a bottom member; and a plurality of reed wires secured at opposite ends in said members in parallel relation and in abutting relation with each other within each frame member, each said reed wire being of one-piece structure with a flattened cross-section between said frame members and an intermediately disposed bend to define a picking channel for a weft yarn each said reed wire being spaced from an adjacent reed wire at said flat cross-section to permit passage of the warp yarn.

16. A reed as set forth in claim 15 wherein said guide elements have ends of circular cross-section secured in said frame, each said end having a diameter equal to the centerline-to-centerline spacing between said guide elements.

17. A reed for a weaving machine comprising a frame having a top member and a bottom member; and a plurality of hair pin shaped reed wires secured at opposite ends in said members in parallel relation, each said reed wire being of one-piece structure with a front limb having a bend therein to define a picking channel for a weft yarn.

18. A reed as set forth in claim 17 wherein said hair-pin shaped wires have two limbs in two different planes transverse to said frame, a front limb of each element having a portion coinciding with the rear limb to define a passage for a warp yarn.

19. A reed as set forth in claim 17 wherein said limbs are interconnected at two points of intersection of said bend.

* * * * *